United States Patent [19]

Breck, Jr.

[11] 4,135,707

[45] Jan. 23, 1979

[54] APPARATUS AND METHOD FOR COLLATING AND BUNDLING BELT LOOPS

[75] Inventor: Louis W. Breck, Jr., El Paso, Tex.

[73] Assignee: Billy the Kid, Inc., El Paso, Tex.

[21] Appl. No.: 798,305

[22] Filed: May 19, 1977

Related U.S. Application Data

[62] Division of Ser. No. 741,044, Nov. 11, 1976, abandoned.

[51] Int. Cl.[2] ..... B65H 39/00

[52] U.S. Cl. ..... 270/52; 2/271; 112/121.27; 270/21; 270/53; 270/58

[58] Field of Search ..... 206/390–393; 223/44; 112/121.12, 121.27, 147; 242/67.3 R; 270/32, 37, 58, 53, 21, 52

[56] References Cited

U.S. PATENT DOCUMENTS

| | | | |
|---|---|---|---|
| 3,583,341 | 6/1971 | Birdsong | 112/121.27 |
| 3,661,106 | 5/1972 | Huddelston | 112/121.27 |

*Primary Examiner*—Edgar S. Burr
*Assistant Examiner*—A. Heinz
*Attorney, Agent, or Firm*—Allen D. Brufsky

[57] ABSTRACT

Belt loop plies cut from the same area of a fabric lay are stacked in individual stacks in the order which they are cut and each stack is formed into a chain of belt loops. Each chain is separated into individual loops while collating the individual loops to form groups of loops in which each loop has been cut from the same area on a fabric lay. The individual loops in each group are collated from each chain in side-by-side relation on a conveyor belt in the reverse order in which they were cut from the fabric lay and wound into a bundle so that the first group cut from the fabric lay is on the exterior of the bundle. The collated loops in the bundle can be removed and sewn to garment pieces cut from adjacent areas on the lay to maintain the same shading characteristics of the component pieces of the garment throughout its construction.

9 Claims, 10 Drawing Figures

APPARATUS AND METHOD FOR COLLATING AND BUNDLING BELT LOOPS

This is a division, of application Ser. No. 741,044, filed Nov. 11, 1976, now abandoned.

BACKGROUND OF THE INVENTION

1. Field of the Invention

This invention relates to an apparatus and method for collating belt loops to match their shade with the shade of a garment to which they are to be sewn and for rolling the collated belt loops into bundles for storage and subsequent use.

2. Description of the Prior Art

In my copending patent application, Ser. No. 587,743, filed June 17, 1975, now U.S. Pat. No. 4,034,690, issued July 12, 1977, and entitled "Apparatus and Method for Forming Belt Loops," an apparatus and method for making belt loops from discrete, pre-sized plies of fabric material is disclosed in detail. Specifically, belt loops are cut from fabric plies used to form garment pieces in the exact size of the finished loop to leave as little waste between the garment pieces on the fabric plies, as possible. Each loop ply cut from the fabric is aligned with a folder by pneumatic jets, and transported to the folder by a ram which positions the aligned ply on the conveyor belt feeding the folder. The longitudinal edges of the loop ply are overlapped by the folder along their length. The folded ply is then fed to a sewing means positioned to form stitches over the exposed overlapped edge along its entire length while the alignment is retained. Succeeding loop plies are fed through the folder and sewn in a chain of belt loops after they have been folded. The chain of closely spaced loops are then wound onto a reel.

By using this technique, the small individual belt loops may be nested among the larger parts in a garment pattern in such a way that the belt loops are formed from fabric which would otherwise be wasted. A significant cost savings of material is realized by providing loop pieces cut to the exact length and width without wastage of fabric.

It is most desirable to collate the belt loops cut from a particular garment pattern with the larger pattern pieces cut from the same location on the pattern. The color or shade of the fabric material will differ at different portions of the same fabric from which the garment parts are cut. Therefore, belt loops cut from an area adjacent to other components of the same garment should be used with those components when sewing the complete garment. Otherwise, there may be a significant difference in color in the "shading" of the belt loops and other garment components.

Heretofore, belt loops were "shaded" or collated with adjacent garment components cut from the same fabric lay by placing a mark on the loop plies corresponding to the position of the garment components on the pattern adjacent to which they were cut. The marked plies after being formed into belt loops were accumulated and separated according to their markings and placed into a receptacle having compartments corresponding to each garment position on the pattern. When the time came to sew the completed garment, the loops corresponding to the larger components were removed from the corresponding receptacle compartment for use with the larger components, Obviously, this is a tedious and time-consuming manual chore.

The present invention provides an apparatus and method for automatically collating and bundling the chains of belt loops formed in accordance with my material saving technique to correspond them to garment components which are cut from an adjacent area on a garment pattern. The loops are cut from adjacent areas on a fabric as the larger garment components and are kept in the same order as the garment components throughout the belt-loop forming process.

SUMMARY OF THE INVENTION

In accordance with the invention, the loop plies cut with the larger garment components are maintained in the same order throughout the belt loop forming process as follows:

If the finished garment is to have six loops, for example, each of the six loop plies cut for garment number 1 are stacked in six individual stacks. Each loop is the first or top ply of six stacks of belt loop plies. Each succeeding ply in each stack corresponds to garment numbers 2, 3 . . . . and so forth up to the number of garments formed from a single fabric lay. The ultimate objective is that each of the fabric pieces in the first ply in each stack be used and sewn to the first garment cut from the fabric lay. This maintains the color or shading characteristics of the loops with respect to the finished garment.

If the larger garment components are cut in pairs or what is commonly known as "face-to-face," three stacks of loop plies are formed in which the first two plies in each stack correspond to garment number 1, the next two correspond to garment number 2, and so forth until all of the loop plies are cut. In other words, when cutting the patterns in "face-to-face" pairs, three stacks of loop plies are formed in which the six loops of one garment constitute the first two plies in "face-to-face" relation in each of three stacks.

Each stack of loop plies (six or three depending on whether the pattern is cut facing one way or in pairs, i.e. "face-to-face") is fed serially and formed into belt loops in a connected chain as disclosed in my copending patent application. The first chain is taken off the apparatus and reeled onto a reel. The second chain of loops formed from the second stack of loop plies is then reeled onto a second reel adjacent to the first reel until six reels in total are provided which contain the six stacks of belt loops. When they are reeled onto the reels, the loop corresponding to the first garment cut from the pattern is on the inside of each reel and the last loop corresponding to the last garment components cut from the pattern is on the outside circumference of each reel.

In the pairs arrangement (three stacks), wherein two "face-to-face" loop plies are serially fed through the apparatus, the successive plies are flip-flopped by the feed arrangement. In the chain which emanates from the apparatus, the first two belt loops on each of the three reels which are on the inner circumference of the reels both correspond to the first garment components cut from the garment pattern, the second pair of loops correspond to the second garment components cut, and so forth up to the last pairs which are on the outer circumference of each reel.

Each reel which is so formed is slid onto a spindle on the collating and bundling apparatus of the present invention. The collating and bundling apparatus cuts the threads attaching the outermost loops of each reel to the successive loops and simultaneously loads the six loops from each reel (or three in "face-to-face") onto a conveyor. The conveyor then indexes to provide room for a second set of loops and the cycle repeats. The conveyor feeds the loops between a thread and tape onto a paper core to form a bundle of loops in collated numerical sequence in which the six loops for each garment are spaced from an adjacent group of six. A printer marks the tape with a number corresponding each group of six loops to the corresponding garment.

Since the last cut loops are first off each reel, they will wind up adjacent the inner circumference of each bundle with the first loops cut adjacent the outer circumference of each bundle. Accordingly, the printer will mark the tape in reverse order, counting down from the last numbered garment cut to the first. Where three reels are emptied, the first two groups of these loops provided on the conveyor and subsequently rolled into a a bundle will comprise the requisite six loops corresponding to the last garment cut. The printer is programmed to skip print every other cycle so that the bundling tape identifies a group of six loops as corresponding to a particular garment.

The resultant bundles are then stored until the loops are ready to be sewn to the garments, whereupon the first six loops in any bundle correspond in color or "shade" to the first garment cut from the same fabric lay, which have been stacked in order in the sewing room.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
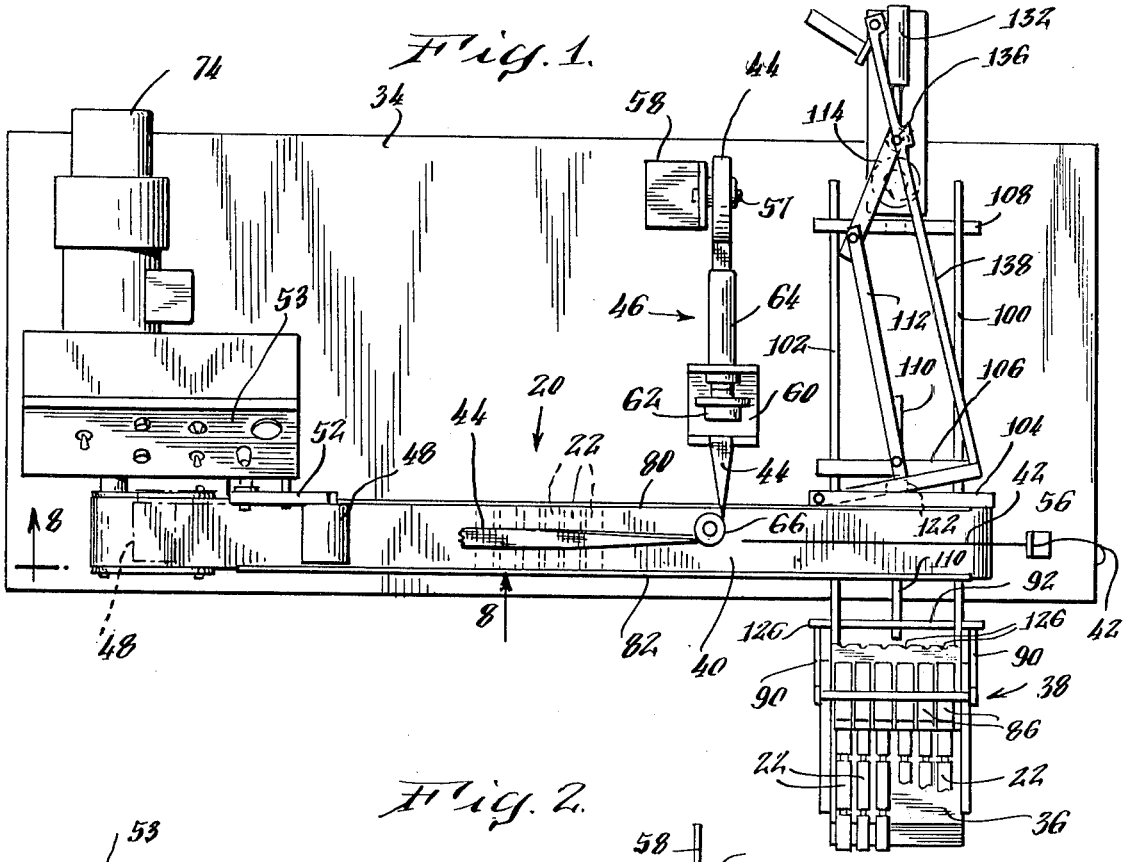
FIG. 1 is a top plan view of the collating and bundling apparatus of the present invention.
Figure 2:
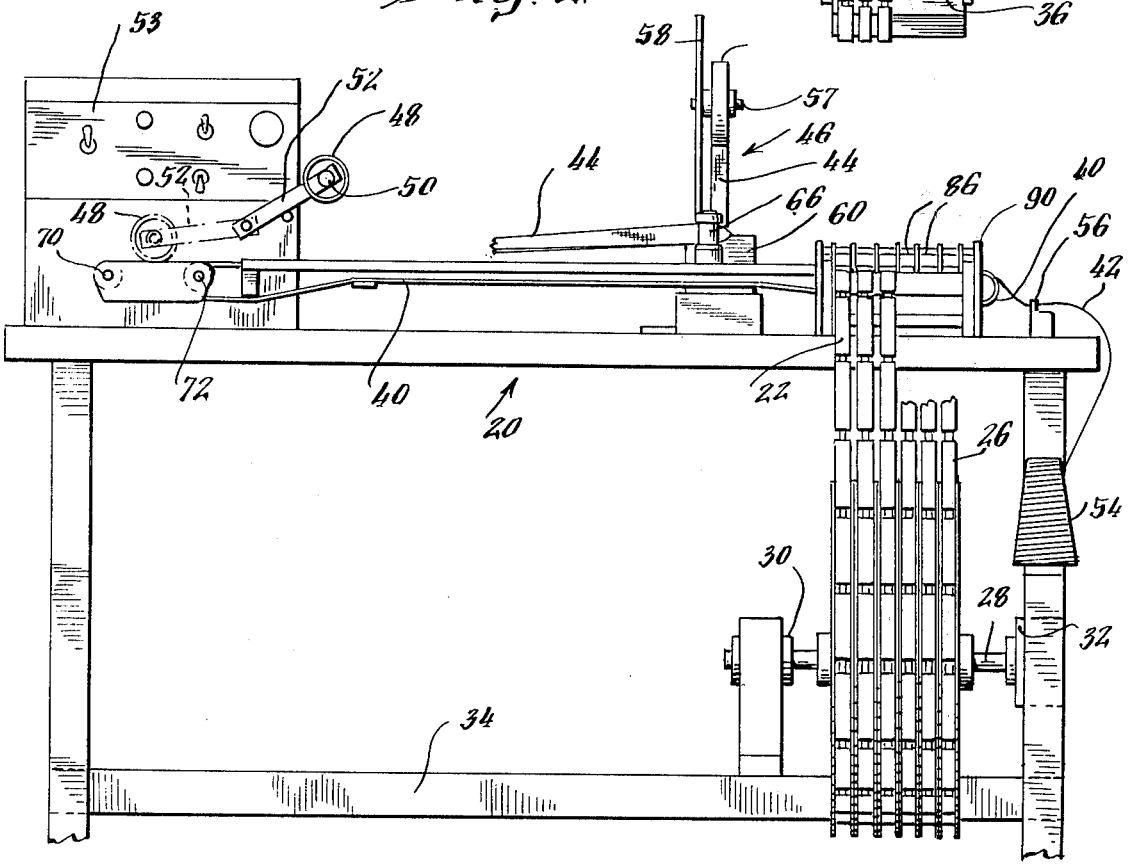
FIG. 2 is a front view in elevation of the apparatus of FIG. 1.

Referring now to the drawings in detail, wherein like numerals indicate like elements throughout the several views, the apparatus for collating and bundling belt loops in accordance with the method described is shown in FIGS. 1 and 2 and identified generally by the numeral 20. The operation of apparatus 20 will be described in forming bundles of belt loops in which six loops 22 are grouped and spaced from each other in a bundle 24, although it should be understood that the spaced groups of loops 22 may comprise two groups of three loops each, as previously discussed, depending upon the number of reels 26 of loops 22 mounted on the apparatus 20. Assuming that the belt loops have been cut from the fabric lay facing "one way" and that six loops are required for each finished garment, six reels 26 containing chains of loops 22 are provided for use with the apparatus 20. The outermost loop 22 in each reel 26 corresponds to one of the last cut loops adjacent the last cut garment pieces in the fabric lay and the innermost loop 22 in each reel corresponds to one of the first cut loops 22, as previously explained, and each reel 26 contains one of these six loops.

Each of the reels 26 are mounted adjacent to each other on a spindle 28 rotatably mounted in bearings 30 and 32 on the frame 34 of apparatus 20. Each of the first six loops from the reels 26 are entrained about a top plate 36 of a carriage mechanism 38 which feeds and positions six of the loops in side-by-side relation onto a moving conveyor belt 40. Conveyor belt 40 transports the six loops between a thread 42 and a tape 44 past a printing station 46, and rolls the loops into the bundle 24 on a paper core 48 positioned on a roller 50 mounted on the end of a rotatable arm 52 on an upright panel 53. Spring means (not shown) on the rear of panel 53 normally biases arm 52 downwardly towards the top of belt 40. The bundle 24 contains spaced groups of six loops 22 in which the outermost group will correspond to the first garment pieces cut from the fabric lay.

A thread package 54 is mounted on a spindle on the frame 34 of apparatus 20. Thread 42 from package 54 is passed through a thread tensioning eye on a guide 56 onto the upper run of conveyor belt 40 and wound on core 48. The loops 22 fed and positioned by carriage 38 on the upper run of conveyor belt 40 are disposed on top of thread 42. A paper tape 44 mounted on a shaft 57 on a support 58 connected to the frame 34 of apparatus 20 is fed through a support 60 in front of a printing head 62 operable by an air cylinder 64 to print a number on the tape 44 which identifies each group of belt loops 22 in bundle 24 to a garment cut from the fabric lay. The tape 44 is entrained about a vertical roller 66 to turn the tape 90° so it overlies the series of loops 22 on thread 42. Both the tape 44 and thread 42 are wound about paper core 48 so that rotation of paper core 48 will pull both the tape and thread along with the spaced groups of belt loops 22 onto the core 48 to form bundle 24 on core 48.

Conveyor belt 40 is driven by a second endless belt 68 entrained about a pair of rollers 70 and 72. Roller 70 is connected to a motor 74 which drives the roller 70 to turn belt 68 about roller 70 and idler roller 72. The top run of belt 68 is in contact with the bottom surface of the top run of conveyor belt 40 to drive conveyor belt 40 in an endless fashion about supports 76 and 78 spaced along belt 40. Arm 52 which mounts roller 50 which carries core 48 is positioned on the upper run of belt 40 over drive belt 68. Inner belt 68 drives belt 40 which carries the thread 42 and tape 44 into rotational engagement with core 48 enabling the tape and thread as well as the loops 22 disposed therebetween to be wound on paper core 48. Because of belt 68, the end of belt 40 is prevented from unduly sagging maintaining frictional contact at all times between the upper run of belt 40 and bundle 24 as it increases in size. Further, because of this drive arrangement, the relatively long belt 40 may have a minimum of tension applied to it, enabling it to be loosely supported about its support guides, thereby preventing it from jamming or breaking. The short belt 68 is tightly tensioned to provide the requisite support and frictional drive.

The upper run of belt 40 is supported in opposite U-shaped edge guides 80 and 82 to restrain lateral movement of belt 40 as the loops 22 are fed and positioned on belt 40. Otherwise, the belt 40 can be misaligned and shifted by frictional engagement of the loops as they come across and are deposited on the belt 40. The edge guides 80 and 82 are connected to supports 84 on the frame 34 of the apparatus 20. Alternatively, the lateral edges of the belt 40 can be knotted or beaded inside V-shaped edge guides 82 and 84 so as to prevent shifting of the belt relative to the supports 84.

The carriage mechanism 38 for feeding the belt loops 22 from reels 26 onto conveyor belt 40 includes a top plate 36. The loops 22 are threaded through a plurality of clamps 86 pivotably mounted on a shaft 88 supported between a pair of substantially L-shaped arms 90 which straddle top plate 36. Connected between the lower portions of L-shaped arms 90 is a bar 92. The belt loops 22 are threaded into clamp 86 which contains a leaf spring 94 having teeth 96 at one end thereof for frictionally gripping each loop as it passes therethrough and prevents its movement in a direction to the left, as viewed in FIG. 7, once threaded through the clamp 86.

The top edge of a substantially vertical plate 98 supports plate 36. An elongated rod 100 and 102 each have one end thereof fixed to plate 98. Rods 100 and 102 extend through an opening in bar 92, beneath conveyor belt 40, through an upright vertical plate 104 fixed to the frame 34 of apparatus 20 on the opposite side of the conveyor 40, and is fixed to an upright vertical plate 106. The opposite ends of rods 100 and 102 extend through plate 106 and are slidable through a fixed upright guide plate 108 on frame 34 of apparatus 20. A third rod 110 is provided which extends through a frictionally gripping rubber sleeve (not shown) in the center of plate 106. The rod 110 extends through plate 104, beneath conveyor belt 40, and is fixed to the center of bar 92 extending between L-shaped arms 90.

Figure 3:
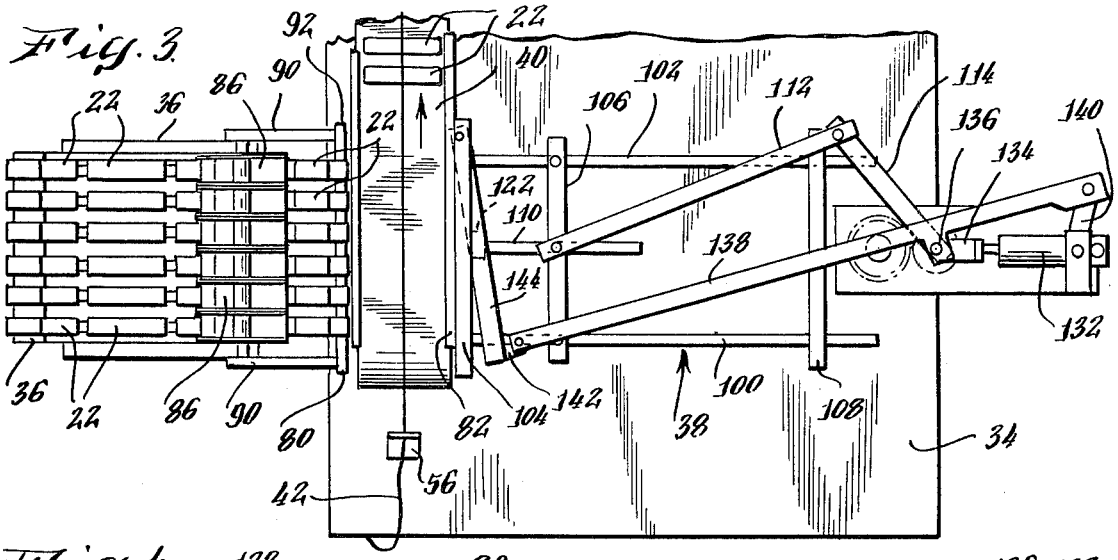
FIG. 3 is an enlarged top plan view of the right-hand portion of the apparatus illustrated in FIG. 1.
Figure 4:
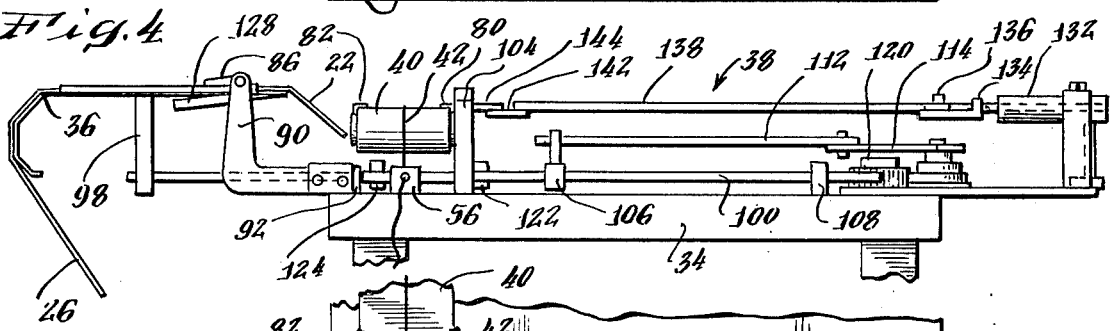
FIG. 4 is a side view in elevation of the apparatus illustrated in FIG. 3 as seen from the bottom of FIG. 3.

Pivotably mounted at one end of the top of plate 106 is a connecting rod 112. Connecting rod 112 has an opposite end pivotably connected to an end of a crank arm 114 whose opposite end is fixed to the drive shaft of a motor (not shown) on frame 34. When this drive motor is active, rotation of crank arm 114 reciprocates connecting rod 112 which in turn reciprocably drives plate 106 and rods 100, 102 and 110. When plate 106 moves in a direction to the left, as viewed in FIGS. 3 and 4, it will move rods 100 and 102, as well as center rod 110, to the left. Movement of rods 100 and 102 to the left will cause vertical plate 98 and top plate 36 to move to the left. Rod 110 also moving to the left causes bar 92 and arms 90, as well as the clamps 86, to move to the left until a stop 122 fixed to rod 110 between plates 106 and 104 abuts fixed plate 104. Continued movement of plate 106 to the left takes place under the urging of crank arm 114 and connecting rod 112 because the rubber friction sleeve mounting rod 110 to the center of plate 106 enables plate 106 to slide relative to rod 110, which is now stationary. Upon abutment of stop 122 with fixed plate 104, plate 106 and the rubber sleeve will serve as a clutch enabling slippage of plate 106 relative to stationary rod 110. The continued relative movement to the left of rods 100 and 102 relative to rod 110 will cause top plate 36 to move rearwardly relative to arms 90 and clamps 86 to pick up additional loops 22 from the reels 26. Simultaneously, the relatively stationary belt loops 22 in the front group on top plate 36 fall over the front edge of plate 36, as shown in FIG. 4, because clamps 86 on shaft 88 fixed to arms 90 are now stationary and teeth 96 on leaf springs 94 prevent rearward sliding movement of the loops 22 relative to top plate 36.

Figure 5:
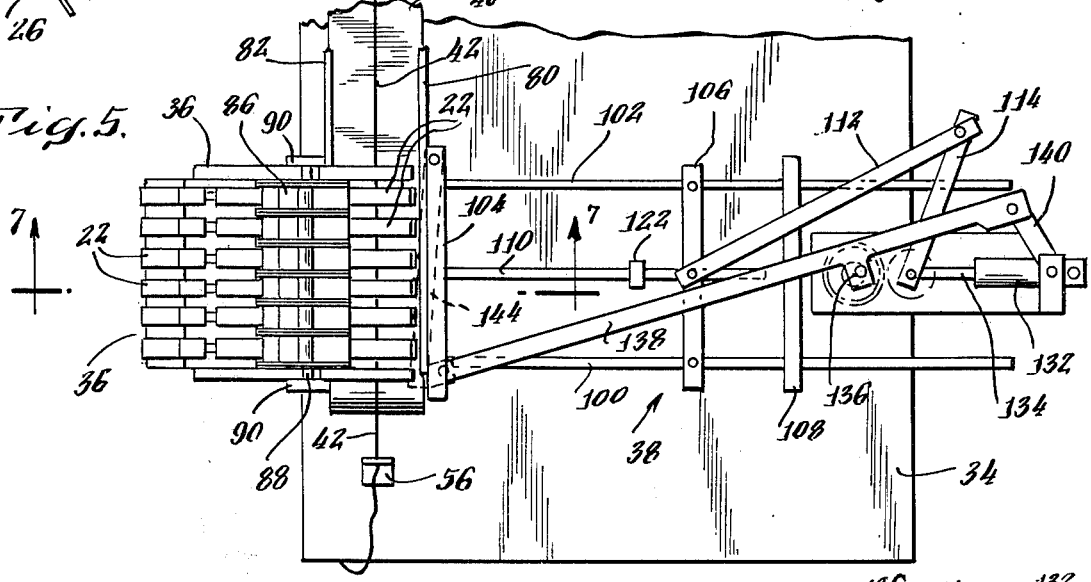
FIG. 5 is a view similar to FIG. 3 but illustrating a subsequent position of the components of the apparatus.
Figure 6:
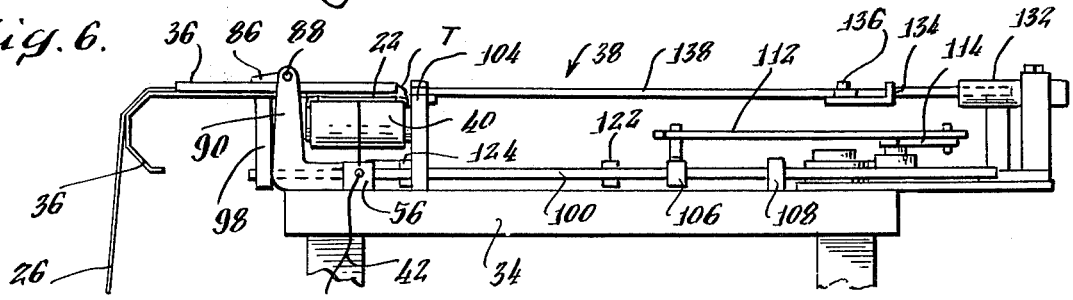
FIG. 6 is a side view in elevation of the apparatus illustrated in FIG. 5 as seen from the bottom of FIG. 5.
Figure 7:
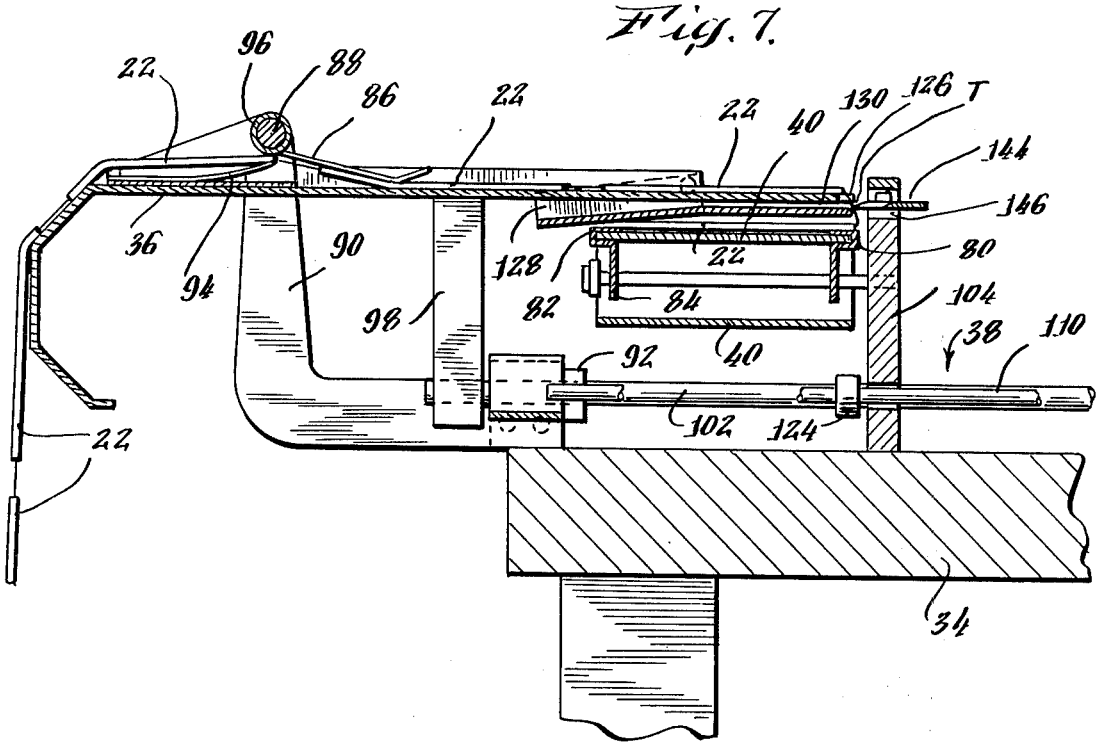
FIG. 7 is an enlarged cross-sectional view taken substantially along the plane indicated by line 7—7 of FIG. 5.
Figure 8:
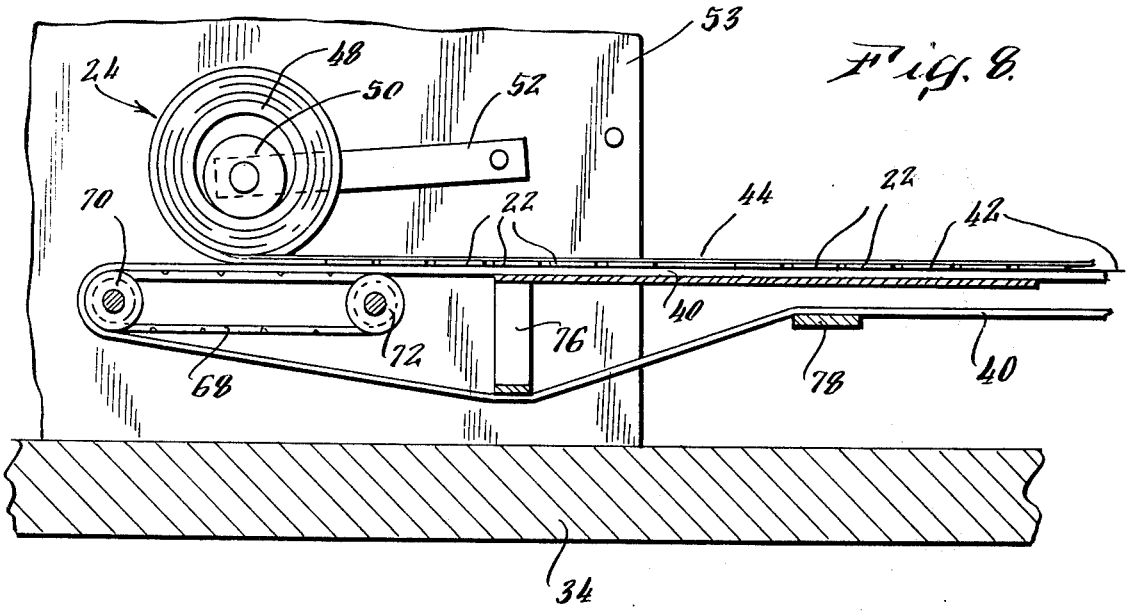
FIG. 8 is an enlarged cross-sectional view taken substantially along the plane indicated by line 8—8 of FIG. 1.
Figure 9:
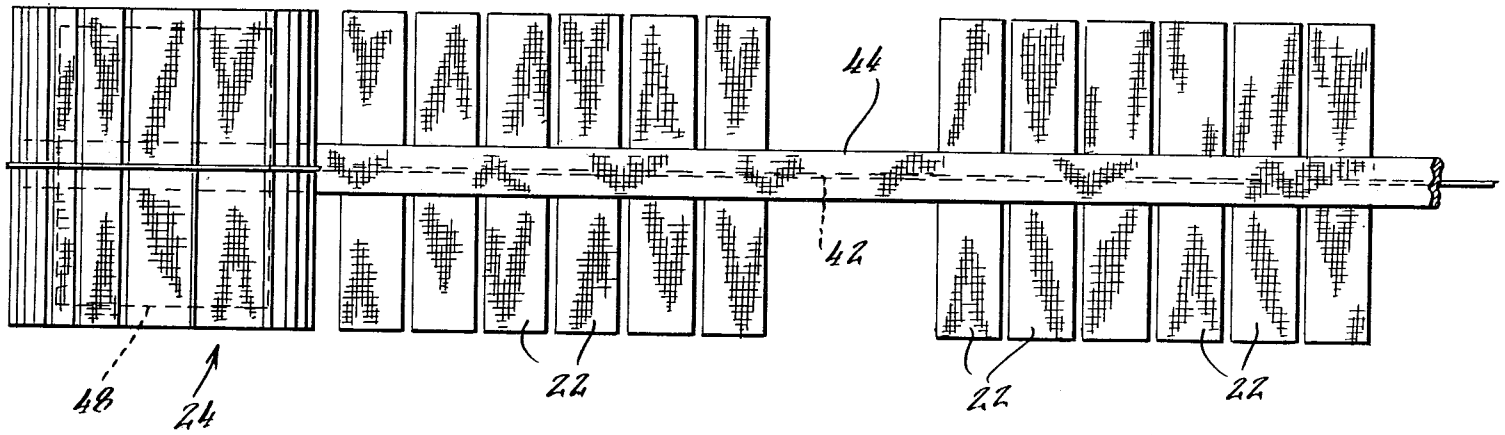
FIG. 9 is a top plan view of a partially formed bundle of belt loops fabricated by the apparatus of the present invention.
Figure 10:
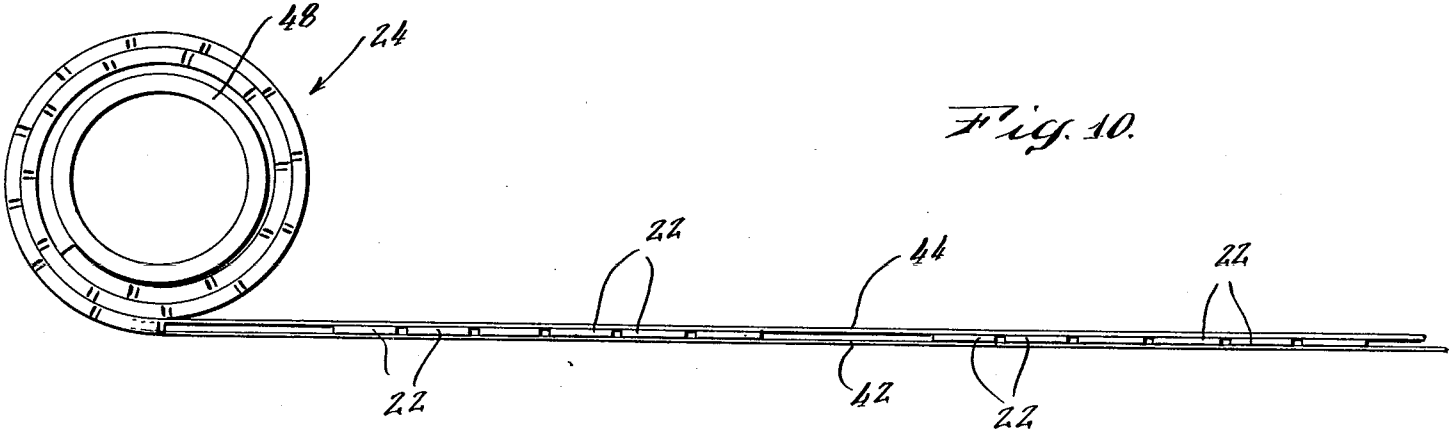
FIG. 10 is a front view in elevation of the bundle of belt loops shown in FIG. 9.

Upon reverse movement being imparted to upright plate 106 through reversal of direction of connecting rod 112, rods 100, 102, as well as rod 110, will now move to the right as shown in FIGS. 5 and 6. Plate 98 connected to rods 100 and 102 will move carriage 36 to the right. Rod 110 will also pull bar 92, arms 90, and the clamps 86 to the right until a second stop 124 on rod 110 to the left of plate 104 between bar 92 and plate 104 abuts fixed plate 104. Once again, the rubber sleeve mounting rod 110 through plate 106 enables plate 106 to continue its movement to the right relative to now stationary center rod 110. This will cause relative movement of top plate 36 relative to stationary arms 90 and clamps 86 to position the first group of belt loops 22 which previously fell over the edge of plate 36, onto conveyor belt 40 in inverted condition and will pull the next successive group of loops 22 through clamps 86 with their edges adjacent the front edge of plate 36, as shown in FIGS. 5 to 7, inclusive.

The front edge of top plate 36 contains a plurality of notches 126 which receive the threads T connecting the first group of belt loops 22 to the successive group of belt loops 22, as the first group of loops fall over the edge of top plate 36 and are folded under plate 36 onto the top of conveyor belt 40. Pivoted to extensions on the sides of top plate 36 is a cam plate 128. As top plate 36 moves forward relative to arms 90, the bottom edge of cam plate 128 strikes the edge guide 82 on conveyor 40 to form an opening 130 between the bottom of cam plate 128 and the bottom of top plate 36.

When plate 106 reaches the forward-most portion of its stroke adjacent to fixed plate 108, plate 106 can strike a switch to activate an air cylinder 132 to extend a piston 134 connected to a laterally extending ear 136 on an elongated arm 138. Arm 138 is pivoted at its opposite ends to a link 140 and a link 142 connected to a knife blade 144 pivoted at one end in a slot 146 in the top of fixed plate 104. The knife blade 144 is pivoted through slot 146 and plate 104 into opening 130 formed between the bottom of top plate 36 and the bottom surface of cam plate 128 to cut the thread T connecting the first group of belt loops 22 to the next successive group permitting the first group of belt loops 22 to be freely movable on conveyor belt 40 with their lateral edges perpendicular to the direction of movement of the belt.

Crank arm 114 turns continuously through the reciprocal cycle of carriage 38. After the severing of the loops is completed in the cycle, motor 74 is activated causing the belt 40 to index and move the first group of belt loops 22 on string 42 towards tape 44. The motor 74 is then deactivated. After belt 40 is indexed and motor 74 deactivated, cylinder 64 operates printing head 62 to identify the loop groups. The printing head 62 can be caused to print during every cycle or to skip a cycle, depending upon whether three or six loops are being fed and deposited on conveyor 40. In the former instance, printing can be done every other cycle so that six loops are available for each garment as previously discussed.

What is claimed as new is:

1. Apparatus for collating and bundling belt loops in the order in which they are cut from a fabric lay comprising:

conveyor means having a longitudinal axis extending in the direction of its travel, means for driving said conveyor means, means for simultaneously feeding and depositing on said conveyor means transverse to the longitudinal axis of said conveyor means individual belt loops from a plurality of chains of belt loops sewn together by connecting threads along spaced lines parallel to side edges of each loop, the loops which are deposited simultaneously forming a group of loops cut from the same area of a fabric lay, cutting means for simultaneously severing the connecting threads between the individual belt loops in each of said chains forming a group of loops simultaneously fed and deposited on said conveyor means, and means cooperating with said conveyor means for winding said severed individual loops forming said groups into a bundle with the side edges of each loop in each group parallel to each other and each group of loops being wound in the sequence in which it is formed from said chains.

2. Apparatus in accordance with claim 1 wherein said winding means includes a core, roller means for mounting said core in contact with one end of said conveyor means, a string wound on said core extending along said conveyor means beneath said severed groups of belt loops, and a tape wound on said core extending along said conveyor means above said severed groups of belt loops.

3. Apparatus in accordance with claim 2 wherein said conveyor means includes a first endless belt having an upper and lower run, one end of said upper run being in frictional contact with said core and roller means, and a second endless belt between the upper and lower runs of said first endless belt at said one end of said first endless belt in frictional engagement with the upper run of said first endless belt.

4. Apparatus in accordance with claim 3 wherein said drive means includes a pair of rollers in frictional engagement with said second endless belt, and motor means for rotating one of said rollers.

5. Apparatus in accordance with claim 1 including means for printing an indicum on said tape means adjacent each group of severed belt loops wound onto said core to identify the fabric lay area from which each group of loops on said core were cut.

6. Apparatus in accordance with claim 1 wherein said means for simultaneously feeding and depositing individual belt loops from said chains of belt loops on said conveyor means includes carriage means adjacent said conveyor means, means for reciprocating said carriage means transverse to the axis of said conveyor means to sequentially feed and deposit said individual belt loops from said chains into groups of belt loops on said conveyor means, said carriage means including a first portion, means on said first portion for gripping a group of said belt loops and for permitting movement of said group of belt loops only in a direction towards said conveyor means, a second portion, means connected to said second portion for sliding said second portion relative to said first portion during the reciprocal travel of said carriage means to obtain a successive group of belt loops from a source and to dispose the group of loops gripped by said first portion over a front edge of said second portion while said gripping means on said first portion precludes movement of said first group of belt loops during travel of said carriage means away from said conveyor means, and upon return of said second portion toward said conveyor means to advance said groups of belt loops towards said conveyor means through said gripping means and to deposit the group of loops disposed over the front edge of said second portion on said conveyor means.

7. Apparatus in accordance with claim 6 including means connected to the first portion of said carriage means for reciprocating said first portion towards and away from said conveyor means during a portion of the reciprocal travel of said carriage means.

8. Apparatus in accordance with claim 6 including guide means on the second portion of said carriage means for forming an opening to receive said cutting means to simultaneously severe the stitches between the individual belt loops in each of said chains.

9. Apparatus in accordance with claim 8 wherein said guide means includes a plate hinged to said second portion of said carriage means having a sloping surface adapted to strike the edge of said conveyor means for lowering said plate relative to said second portion of said carriage means to form said opening.

* * * * *